US005471059A

United States Patent [19]

Freedman et al.

[11] Patent Number: 5,471,059

[45] Date of Patent: Nov. 28, 1995

[54] MULTIPLE-DETECTOR SYSTEM FOR DETECING CHARGED PARTICLES

[75] Inventors: Philip A. Freedman, Hartford; Edward F. H. Hall, Winsford, both of England

[73] Assignee: Fisons PLC, Ipswich, England

[21] Appl. No.: 358,231

[22] Filed: Dec. 16, 1994

Related U.S. Application Data

[63] Continuation of Ser. No. 194,928, Feb. 14, 1994, abandoned.

[30] Foreign Application Priority Data

Feb. 12, 1993 [GB] United Kingdom ..... 9302886

[51] Int. Cl.[6] ..... H01J 49/30

[52] U.S. Cl. ..... 250/299; 250/298

[58] Field of Search ..... 250/299, 298, 250/281, 294, 296, 298, 299, 300, 396 R, 397

[56] References Cited

U.S. PATENT DOCUMENTS

| | | | |
|---|---|---|---|
| 3,191,028 | 6/1965 | Crewe | 250/299 |
| 3,240,931 | 9/1962 | Wiley et al. | 250/299 |
| 3,602,710 | 5/1969 | Mueller | 250/299 |
| 3,898,456 | 8/1975 | Dietz | 250/299 |
| 3,955,084 | 5/1976 | Giffin | 250/299 |
| 3,967,116 | 6/1976 | Geerk | 250/298 |
| 4,524,275 | 6/1985 | Cottrell et al. | 250/299 |
| 4,998,015 | 3/1991 | Ishihara | 250/299 |

*Primary Examiner*—Jack I. Berman
*Assistant Examiner*—James Beyer
*Attorney, Agent, or Firm*—Chilton, Alix & Van Kirk

[57] ABSTRACT

A multiple charged-particle detector system includes a plurality of charged-particle detector assemblies (10–12) which are each made up of a first arm (19–22) and a second arm (24–27) extending at an angle to each other. Charged particles (4–7) enter an aperture (14–18) at the entrance of the first arm (19–22) of each detector assembly (10–12) and strike a dynode (30–33) positioned at the intersection of the two arms causing electrons to be emitted by the dynode (30–33). Some of the electrons pass into the second arms (24–27) of the detector assemblies (10–12) and are detected by a continuous-dynode electron multiplier (35–38). The first arms (19–22) are narrower than the detectors (35–38), and the detector assemblies (10–12) are arranged in such a way that the minimum separation at which charged-particle beams (4–7) can be detected is determined by the widths of the said first arms (19–22) of the detector assemblies (10–12), and not by the widths of the detectors (35–38) themselves.

11 Claims, 6 Drawing Sheets

MULTIPLE-DETECTOR SYSTEM FOR DETECING CHARGED PARTICLES

CROSS REFERENCE TO RELATED APPLICATION

This application is a continuation of abandoned application Ser. No. 08/194,928 filed Feb. 14, 1994.

TECHNICAL FIELD

This invention relates to multiple-detector systems for detecting charged particles. It is particularly, although not exclusively, relevant to multiple-detector systems used in spectrometers, for example Isotope-Ratio Mass Spectrometers which are used for the determination of the isotopic composition of materials.

BACKGROUND ART

Many analytical devices involve the simultaneous detection of charged particles at a plurality of locations. In order to do this, an array of charged-particle detectors may be used. The minimum size of these detectors is a limiting factor in determining the minimum spacing apart at which the detectors may be positioned, and thus the minimum spacing at which particles may be detected, and this spatial limitation poses a problem which must be solved in designing the device. Another frequent requirement of multiple-detector systems is that the detectors be adjustable in their relative positions, so that charged particles may be simultaneously detected at a plurality of locations, the spacings of which locations may be varied. An example of a field in which both these requirements must be met is isotope-ratio mass spectrometry.

Isotope-ratio mass spectrometers are well known in the prior art. Typically, such an arrangement will consist of an ion source for generating a beam of ions which are characteristic of the element (or elements) in the sample to be analyzed; a mass analyzer for dispersing the ions in the beam to follow different trajectories according to their mass-to-charge ratios; and a plurality of ion detectors, each of which is positioned to detect ions of a particular mass-to-charge ratio. The mass analyzer, for example a sector magnet, effectively separates the incident ion beam into a plurality of dispersed beams which are focused at different points on the focal plane of the magnet, the points at which particular particle beams are focused on the focal plane being determined by the mass-to-charge ratios of the particles. In such a device, a plurality of particle beams may be detected simultaneously, giving a rapid and accurate measurement of the isotopic composition.

For a given mass spectrometer configuration, the spacing between the positions at which ions are detected will vary depending upon the different mass-to-charge ratios of the various isotopic beams to be measured. Typically, the distance between isotope beams to be detected is in the range of a few millimeters, so that the detectors employed must be capable of detecting ion beams only a few millimeters apart.

One type of ion detector which may be used is the continuous-dynode electron multiplier. A continuous-dynode electron multiplier is a tube of high-resistivity glass which has the property that when a charged particle strikes it, secondary electrons are emitted. The secondary electrons in their turn hit the inner wall of the tube and this process is repeated causing more and more emissions, so that at the output end of the tube a large electron signal is detected.

Typically, the tube is curved and diminishes in cross-section along its length. It is possible to manufacture continuous-dynode electron multipliers which are small enough to be placed a few millimeters apart, but these have some drawbacks in that they are not as reliable as the larger models, they are more expensive to produce and they do not have a large dynamic range (i.e., a constant response over a wide range of intensities) which is very important in isotope ratio analysis where the ratios of adjacent peak heights may be greater than 1,000,000:1.

Another method for detecting ion beams which are very close together is to use a channel-plate detector. A channel plate is typically a disc of high-resistivity semiconducting glass with many tiny pores, which are the openings of tiny channels through the plate, each channel acting as a continuous dynode electron multiplier. A channel plate may have thousands of pores per square millimeter and would therefore have no difficulty in detecting beams a few millimeters apart. Channel plates do, however, have drawbacks. The lifetime of channel plates is poor as they tend to burn out after a while. Also, the existence of the pores affects the observed peak shape, which depends on the position at which the ion beam strikes the plate surface.

In order to be able to look at the isotopic composition of a plurality of different materials, another desirable feature of isotopic-ratio mass spectrometers is that the ion detectors be adjustable in their relative positions, because, as stated above, for a given mass spectrometer configuration the positions of the ion beams to be detected will vary according to the mass-to-charge ratios of the isotopes in question.

An isotope-ratio mass spectrometer incorporating many of the above features is shown in U.S. Pat. No. 4,524,275 (Cottrell et al), which is incorporated herein by reference. In this device, an ion source produces a beam of ions which are dispersed by a sector magnet and detected by a plurality of ion detectors. The magnet is shaped so that the dispersed ion beams are focused on a plane which is substantially perpendicular to the optical axis. As discussed in the patent, this arrangement addresses a number of the defects found in prior isotope-ratio mass spectrometers. Sensitivity and accuracy are increased because the arrangement of the collector slits avoids the problem of off-axis beams striking part of an up-stream detector assembly and being deflected into a down-stream detector, giving a spurious signal. Further, the fact that the detectors are arranged along a plane which is substantially perpendicular to the optical axis simplifies the mechanical linkages required to alter the positions of the detectors. However, this device suffers from the prior art problem that the minimum spacing of the detectors across the focal plane is limited by their size.

Another design of isotope-ratio mass spectrometer is shown in U.S. Pat. No. 5,220,167 (Brown et al), which uses ion-optical magnification to increase the spacing between adjacent beams of a mass spectrometer. In this device, ions are produced and initially focused in the conventional way. After initial focusing, the ion beams are refocused by a magnifying focusing assembly which is located past the focal plane. The magnifying lens magnifies the beam spacing, and the focal plane, along which is located a series of staggered detector assemblies. Each detector assembly (which comprises a conversion dynode and an electron multiplier) receives one of the ion beams through an opening in the side of the assembly, the other beams travelling past to be detected by subsequent detector assemblies. Ions which have entered a particular detector assembly strike the conversion dynode and generate secondary electrons, which are detected by the electron multiplier, which extends substantially perpendicularly to the optical axis. The magnification of the focal plane of the ion beams allows the detector assemblies to be staggered next to each other along the focal plane. However, the Brown et al device has several significant drawbacks the addition of the magnifying focusing assembly greatly increases the complexity of the system, and introduces a further source of aberrations. It also involves the provision of a 30 kV supply and associated control electronics, and necessitates a substantial increase in the distance between the mass analyzer and the detector assemblies, which means that the size of the vacuum housing in which the system is situated must also be substantially increased.

It is an object of the present invention to provide a multiple-detector system for detecting multiple beams of charged particles in an analytical device which is simple in its construction and in which particles can be detected at positions which are separated by distances smaller than the widths of the detectors.

It is another object of the present invention to provide a multiple-detector system for use in an analytical device, in which particles can be detected at positions which are separated by distances smaller than the widths of the detectors, the said multiple-detector system being simple in its construction and having charged-particle detectors which are reliable, have a long lifetime and a large dynamic range.

It is still another object of the present invention to provide a mass spectrometer having such a multiple-detector system.

SUMMARY OF THE INVENTION

In accordance with the above-mentioned objects, the invention provides a multiple-detector system for detecting a plurality of charged-particle beams in an analytical device, said detector system comprising at least one group of charged-particle detector assemblies;

wherein each said detector assembly comprises a first arm and a second arm extending at an angle to said first arm, said first arm having a member at one end thereof defining an entrance aperture, said second arm having a detector therein;

wherein said detector assemblies are arranged such that said entrance apertures lie substantially on a first plane which intersects the paths of said charged-particle beams, one or more of said detector assemblies being positioned so that a selected charged-particle beam passes through said entrance aperture of a selected detector assembly into said first arm of said selected assembly;

each said detector assembly further comprising a secondary-emissive element positioned to intersect the path of a said charged-particle beam which enters said detector assembly through said entrance aperture, said secondary-emissive element emitting secondary particles in response to said charged particle beam incident upon it, with at least some of said secondary particles being able to pass into said second arm of the said detector assembly to be detected by said detector.

The first arms are able to have smaller widths than the detectors in the second arms, and the various detector assemblies within the group are able to be arranged in such a way that the minimum separation at which charged-particle beams can be detected is determined by the widths of the said first portions of the detector assemblies, and not by the widths of the detectors themselves.

Viewed from another aspect the invention provides a mass spectrometer having a vacuum housing containing:

i. a charged particle source, typically an ion source, for producing a charged-particle beam, typically an ion beam;

ii. a mass analyzer for dispersing the charged-particle beam so that the incident charged particles are dispersed along different trajectories according to their mass-to-charge ratios, the dispersed charged-particle beams being focused by the mass analyzer along a plane, with charged particles of different mass-to-charge ratios being focused at different points along the said plane; and iii. a multiple-detector system as defined above.

The first plane along which the apertures of the said detector assemblies are positioned may advantageously coincide with the focal plane of the dispersed charged-particle beams, so that the dispersed charged-particle beams are focused on the said apertures.

In one embodiment, the said second arm of each detector assembly may be positioned substantially at right angles to the said first arm of each detector assembly, with each of the said second arms extending away from the said first arms in substantially the same direction, and with the lengths of the first arms of the various detector assemblies within the or each group progressively increasing by more than the widths of the said second arms so that the detector assemblies within each group may be nested together.

In another embodiment there may be two groups of detector assemblies, with the second arms of the detector assemblies of both of the said groups being substantially parallel to each other, but with the second portions of one group of detector assemblies extending in substantially the opposite direction to the second arms of the other group of detector assemblies, in order to from two back-to-back groups of nested detector assemblies. Alternatively, the said second arms of each detector assembly may not be substantially parallel, but may extend in directions at angles to each other.

In a further embodiment, each said detector assembly is adjustable in position along the focal plane of the charged-particle beams so that charged particles may be detected at varying positions which may be at varying distances apart.

The first arms may be made long enough to substantially prevent particles entering the arm off-axis from reaching the detector, to thereby improve the collimation of the beam before it hits the target.

The charged-particle detectors may be channel electron multipliers. Alternatively, they may be any other suitable charged-particle detector. In a further embodiment, one or more groups of conventional detector assemblies, for example, Faraday cups or channel electron multipliers, may be provided in addition to the one or more groups of detector assemblies as disclosed in the present invention, and arrangements may be provided so that by altering the characteristics of the mass analyzer, the dispersed charged-particle beams are detected by different groups of detectors. According to one aspect, the said secondary-emissive element may be a dynode, the secondary particles emitted by the said dynode being electrons.

Advantageously, the characteristics of the mass analyzer are chosen so that the focal plane of the dispersed charged-particle beams is substantially flat and substantially perpendicular to the optical axis, for example using the configuration shown in U.S. Pat. No. 4,524,275, although the invention is not limited to such a configuration.

The invention also extends to a detector assembly itself for use in the above systems.

DETAILED DESCRIPTION OF THE INVENTION

Certain preferred embodiments of the invention will now be described in detail by way of example only and with reference to the figures, wherein.

Figure 2:
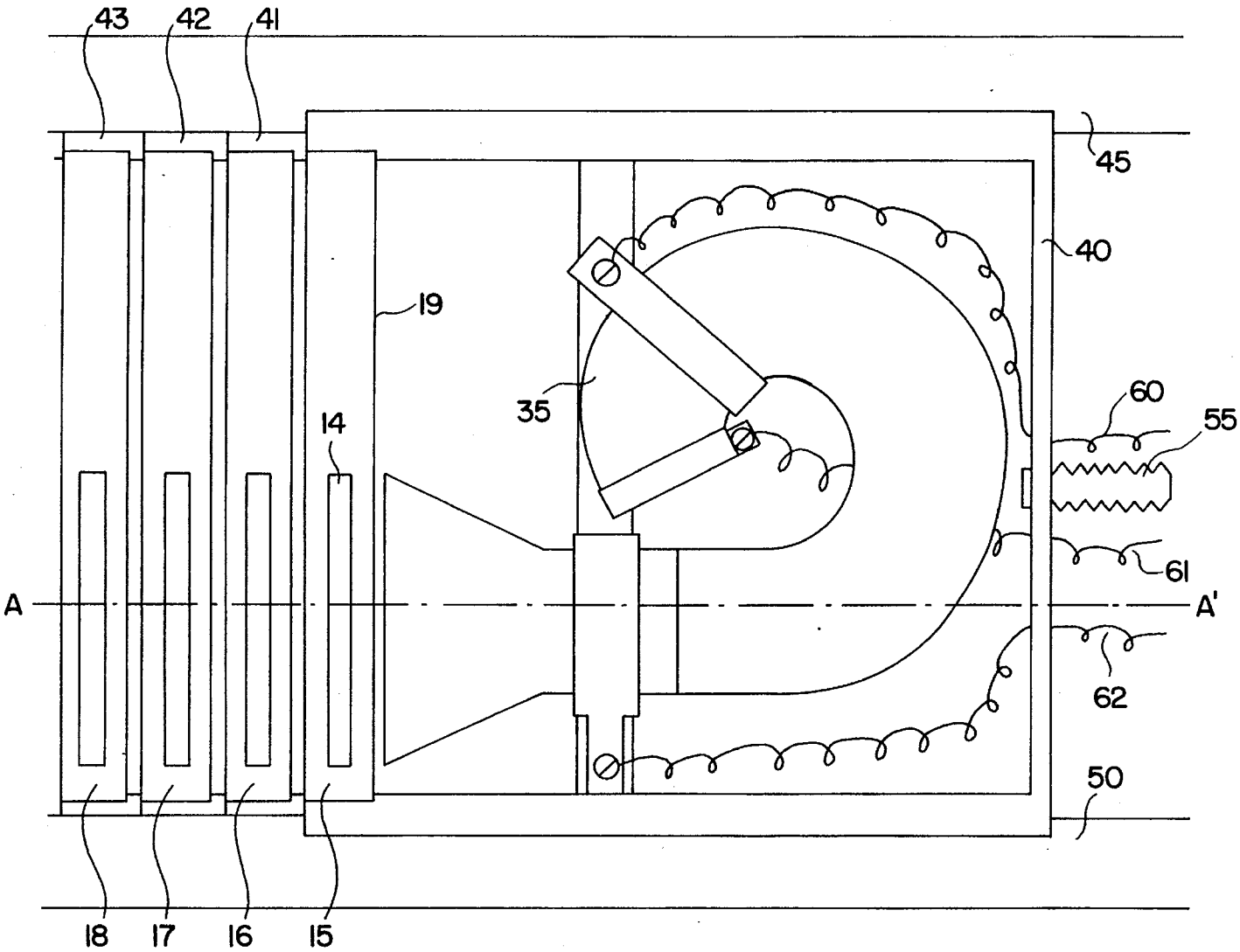
FIG. 2 is a front view of a multiple-detector assembly suitable for use in the spectrometer of FIG. 1, with a front cover of detector assembly 10 being omitted for clarity.
Figure 3:
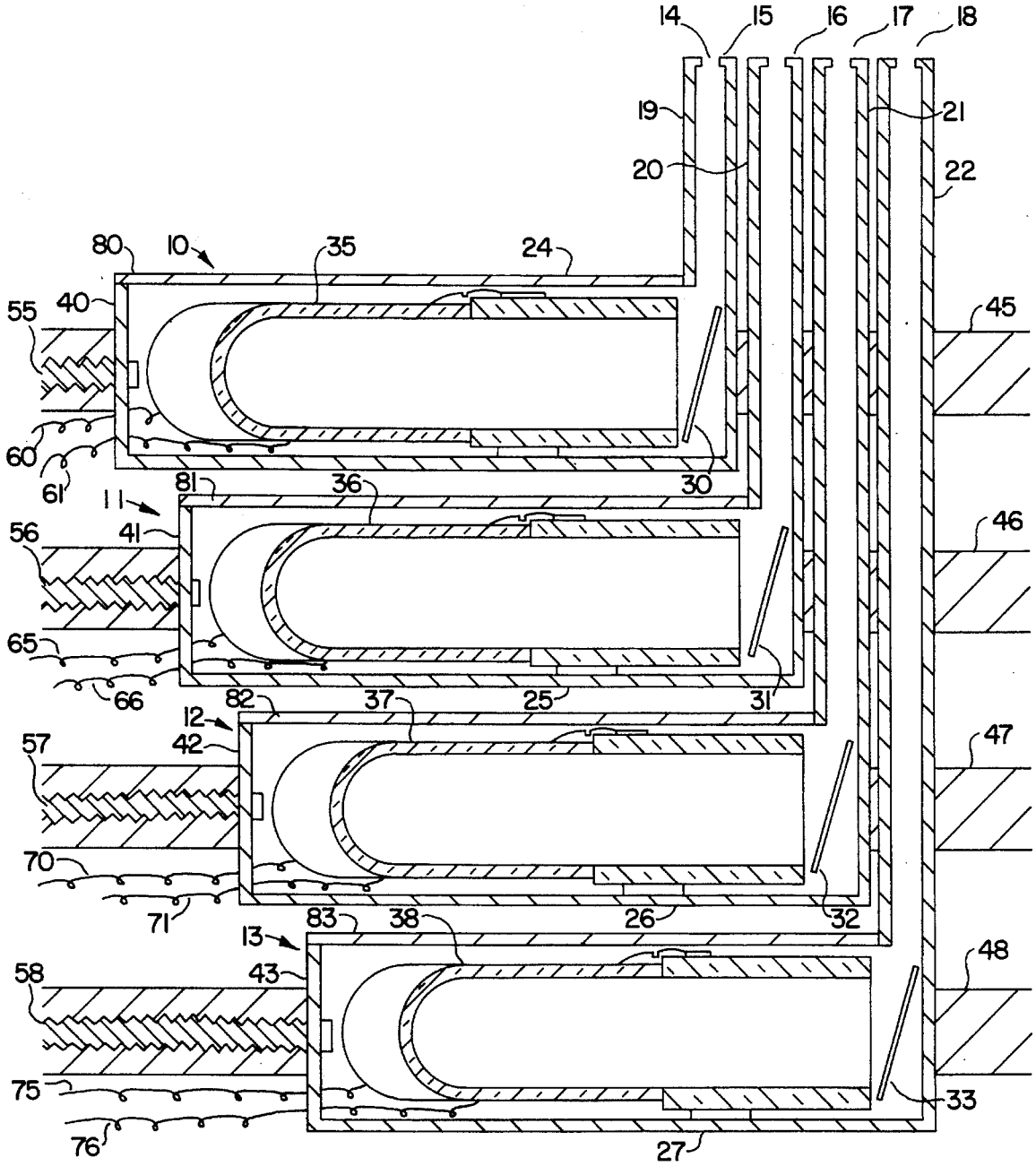
FIG. 3 is a sectional view along the line AA' in FIG. 2.

It will be appreciated that this invention is not limited to a detector assembly for a mass spectrometer as shown in FIGS. 1, 4, 5 and 6, but can be applied to many types of analytical devices having a plurality of detector assemblies arrayed next to each other. Further, although FIGS. 2 and 3 show a channel electron multiplier, the invention is not limited to such detectors but may be used with any suitable detector. Also, the invention is not limited to a device wherein the focal plane of the dispersed beams is substantially perpendicular to the optical axis 8 as shown in the Figures, but may also be applied to a device where the said focal plane is at a different angle to the optical axis 8. In such a device, the detector assembly apertures would be positioned at the foci of the dispersed beams on a plane which is non-perpendicular to the optical axis. In such a device, mechanisms might be provided to adjust the position of the detector apertures in a direction parallel to the said plane, although as pointed out in U.S. Pat. No. 4,524,275, this would involve more complex engineering since the motion required would be at an inclined angle to the optical axis 8. The figures are not drawn to scale.

Figure 1:
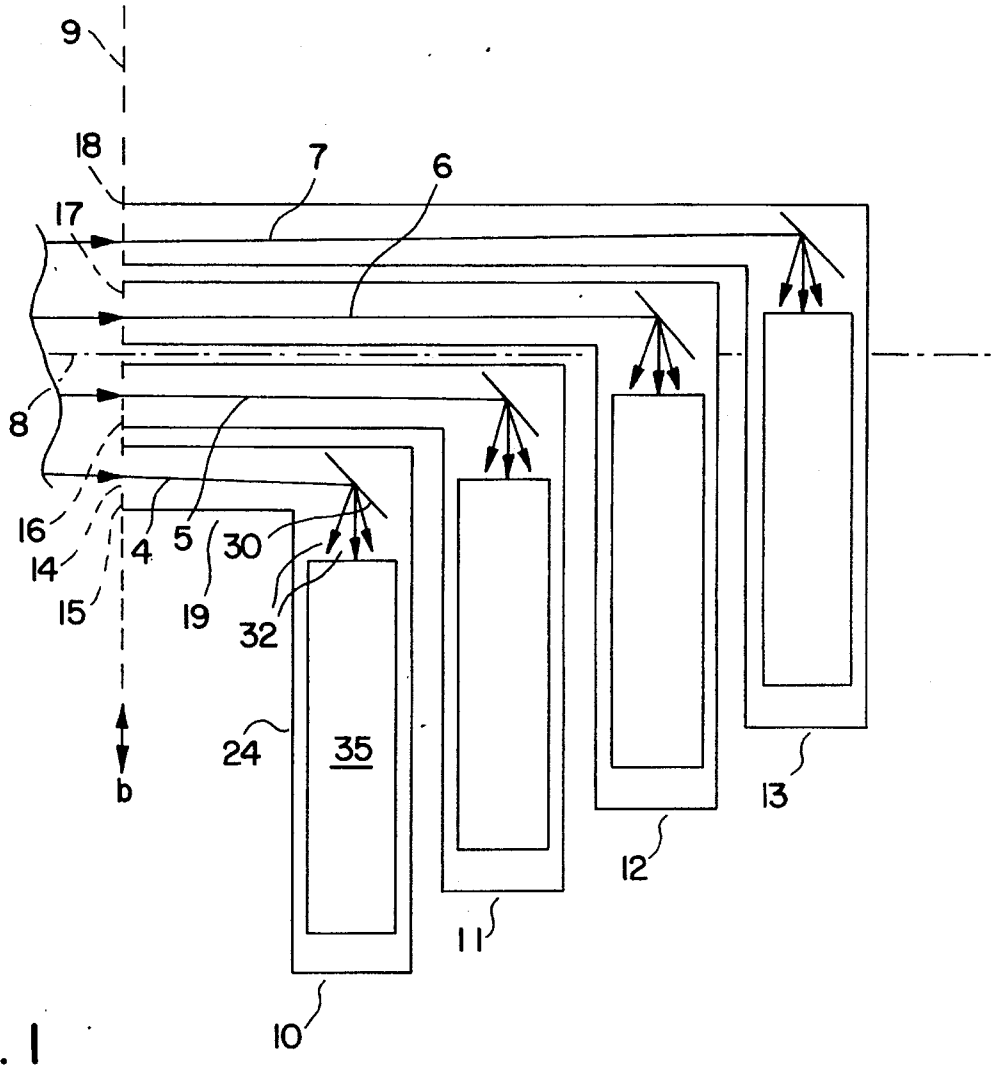
FIG. 1 is a plan view showing the ion optical arrangement of one type of single-focusing multiple-detector mass spectrometer which is constructed in accordance with the present invention.
Figure 1:
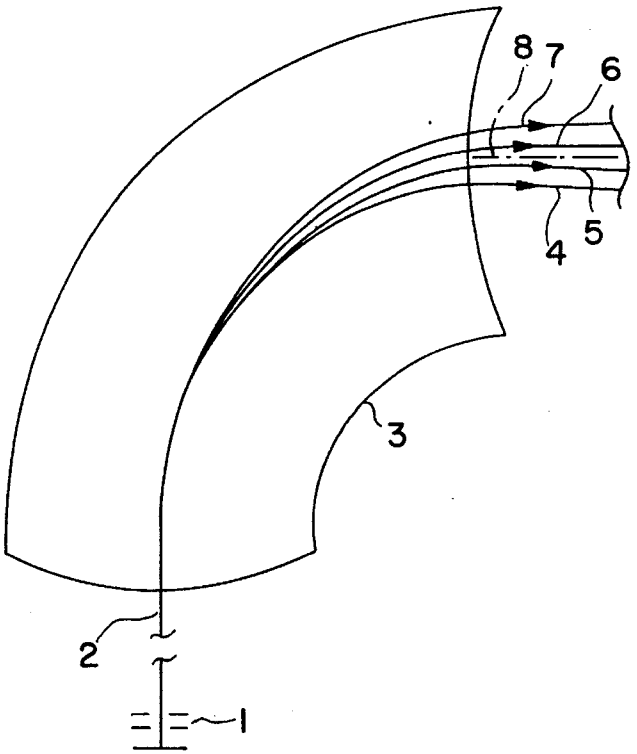

Referring to FIG. 1, charged particles are generated in the charged-particle source 1 (which may be of any suitable type) which generates a charged-particle beam, typically an ion beam, said charged particles following trajectory 2 towards a mass analyzer 3. The incident ion beam is dispersed by the mass analyzer into beams of ions of different mass-to-charge ratios which follow trajectories 4, 5, 6 and 7 respectively. The beam of ions having the lowest mass-to-charge ratio which it is desired to measure, which follow trajectory 4, is focused at aperture 14 which is positioned on the focal plane 9. In the best mode of realizing the invention, mass analyzer 3 is a sector magnet of the type disclosed in U.S. Pat. No. 4,524,275, wherein the magnet is shaped so as to focus the dispersed ion beams on a focal plane which is substantially perpendicular to the optical axis 8. The ion beam passes through aperture 14 in aperture plate 15 of detector assembly 10 to enter the first portion (arm) 19 of the detector assembly. The ions then travel along the first portion of the detector assembly and strike a secondary-emissive element which consists of a dynode 30 placed at the junction between the first 19 and second 24 portions (arms) of the assembly. Ions striking dynode 30 generate secondary electrons 32, some of which pass into the second portion (arm) 24 of the detector assembly 10. These electrons are detected by detector 35. Ions of progressively higher mass-to-charge ratios will follow trajectories 5, 6 and 7, to enter detector assemblies 11, 12 and 13 respectively. Any or all of detector assemblies 10–13 may be adjustable in position along the focal plane 9 of the mass spectrometer (see arrow b).

FIGS. 2 and 3 show simplified views of a multiple-detector assembly according to the invention. FIG. 2 is drawn looking along the optical axis 8 towards detector assemblies 10-13, with front cover 80 (see FIG. 3) of detector assembly 10 removed to show detector 35. Detector assembly 10 is made up of a housing 40 which can be moved along runners 45 and 50 via micrometer shaft 55. Housing 40 contains a detector, in this example a channel electron multiplier 35. Output from the detector is via connecting wire 61, the power supply to the detector being via wires 60 and 62. Charged particles enter the detector assembly through an aperture 14 in aperture plate 15 and pass along the first portion 19 of detector assembly 30 as described above (see FIG. 3). They then strike dynode 30, generating secondary electrons which enter the mouth of detector assembly 35 and strike the inner walls, generating secondary electrons. The process is then repeated as described above, and an amplified signal representative of the electron signal is outputted on wire 61. Apertured plates 16, 17 and 18 belong to detector assemblies 11, 12 and 13 respectively, all of the detector assemblies being constructed in a similar manner. The lengths of the first portions 19–22 of detector assemblies 10–13 progressively increase in order that the detector assemblies may be nested together.

Figure 4:
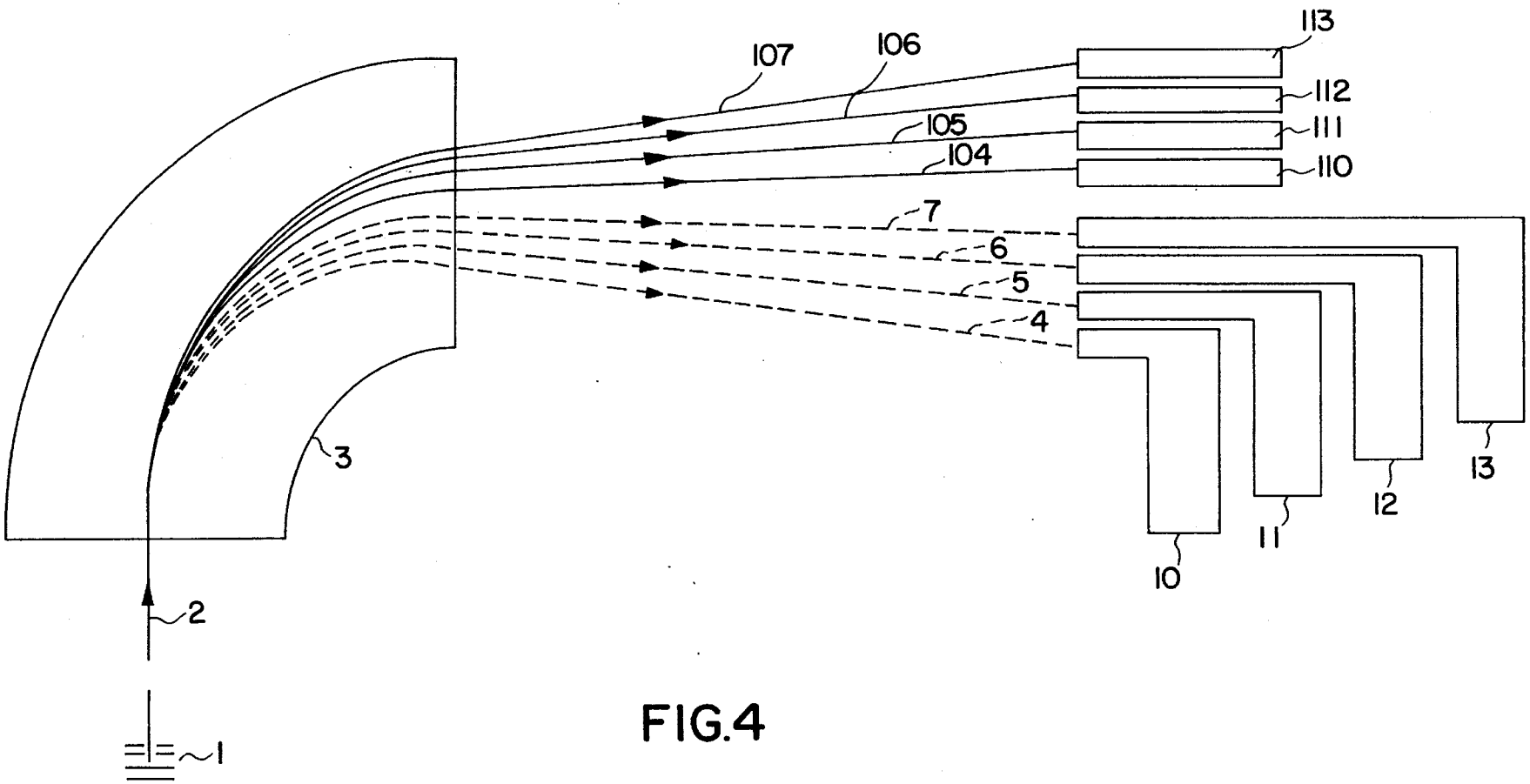
FIG. 4 is a plan view showing a further embodiment of the present invention.

FIG. 4 shows a mass spectrometer similar to that shown in FIG. 1, but with an additional group of charged-particle detectors 110–113. Source 1 generates a beam of charged particles which follows trajectory 2 to enter the mass analyzer 3, which disperses the incident charged-particle beam. The characteristics of mass analyzer 3 may be switched so that the dispersed charged-particle beams may follow either trajectories 4, 5, 6 and 7 (shown by broken lines) or trajectories 104, 105, 106 and 107 (shown by unbroken lines); to enter detectors 10-13 or 110-113 respectively. Detectors 110–113 are conventional detectors, for example, Faraday Cups or Channel Electron Multipliers, while detectors 10–13 are constructed according to the invention. In this way, a selection between different types of detectors is possible.

Figure 5:
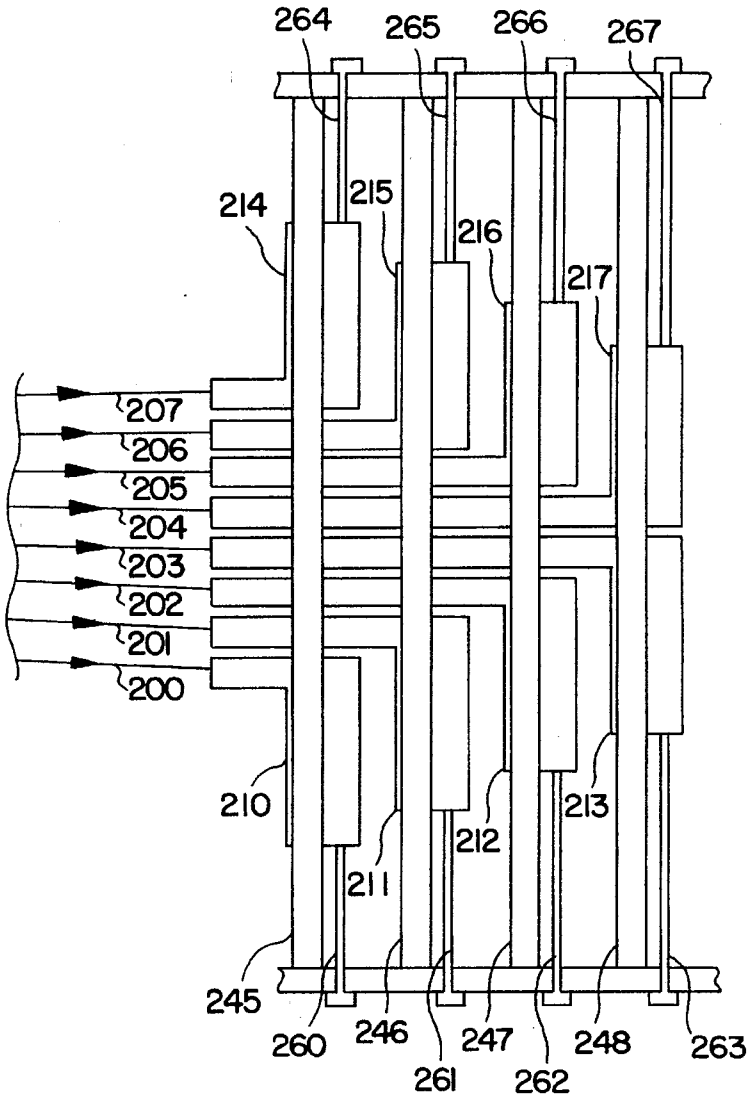
FIG. 5 is a plan view of a still further embodiment of the present invention showing two groups of detectors arranged back-to-back.
Figure 5:
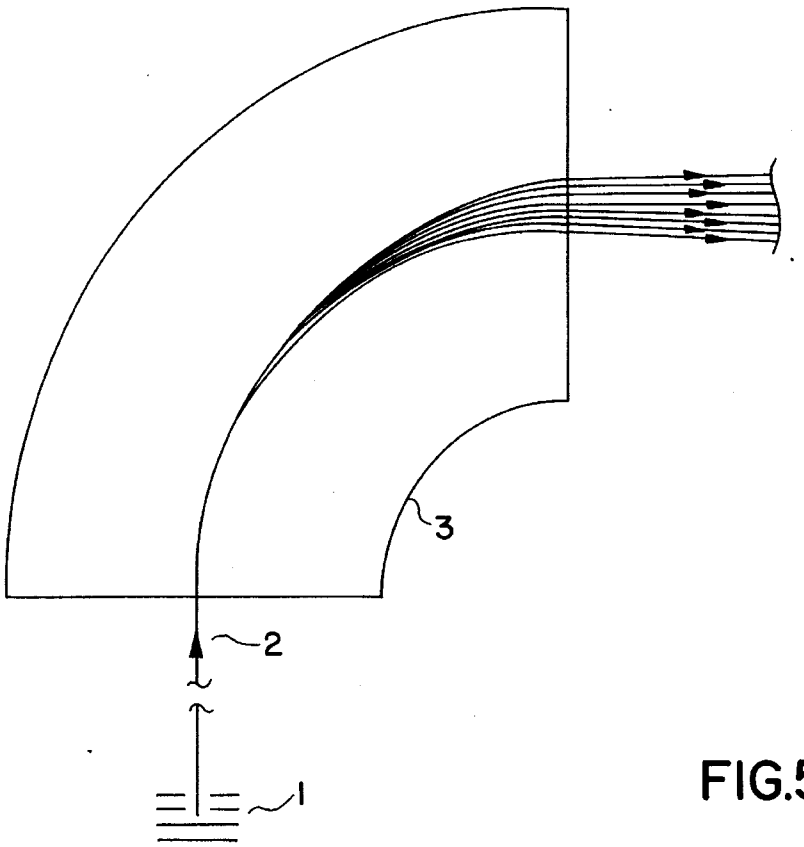

FIG. 5 shows a further embodiment of the present invention. In this example, the charged-particle beam entering the mass analyzer 3 has been dispersed to follow eight trajectories, 200–207. The dispersed beams are detected by two groups of detectors constructed according to the invention, 210–213 and 214–217 respectively. The second portions of the detector assemblies of both of these groups are substantially parallel to each other, but with the second portions of one group of detector assemblies extending in substantially the opposite direction to the second portions of the other group of detector assemblies, in order to form two back-to-back groups of nested detector assemblies. The detectors are adjustable along runners 245–248 by micrometer shafts 260–267 respectively. The arrangement of the two groups of detectors in this example allows two detectors to share the same upper and lower runners.

If desired, the second portions of one group of detector assemblies need not be parallel to those of the other but they may be arranged at an angle. Neither is it necessary for the second portions within one group to be parallel to each other. For example, the second portions 211–213 and 213–217 in FIG. 5 could be splayed out within the 180° arc to the right of portions 210 and 214.

Figure 6:
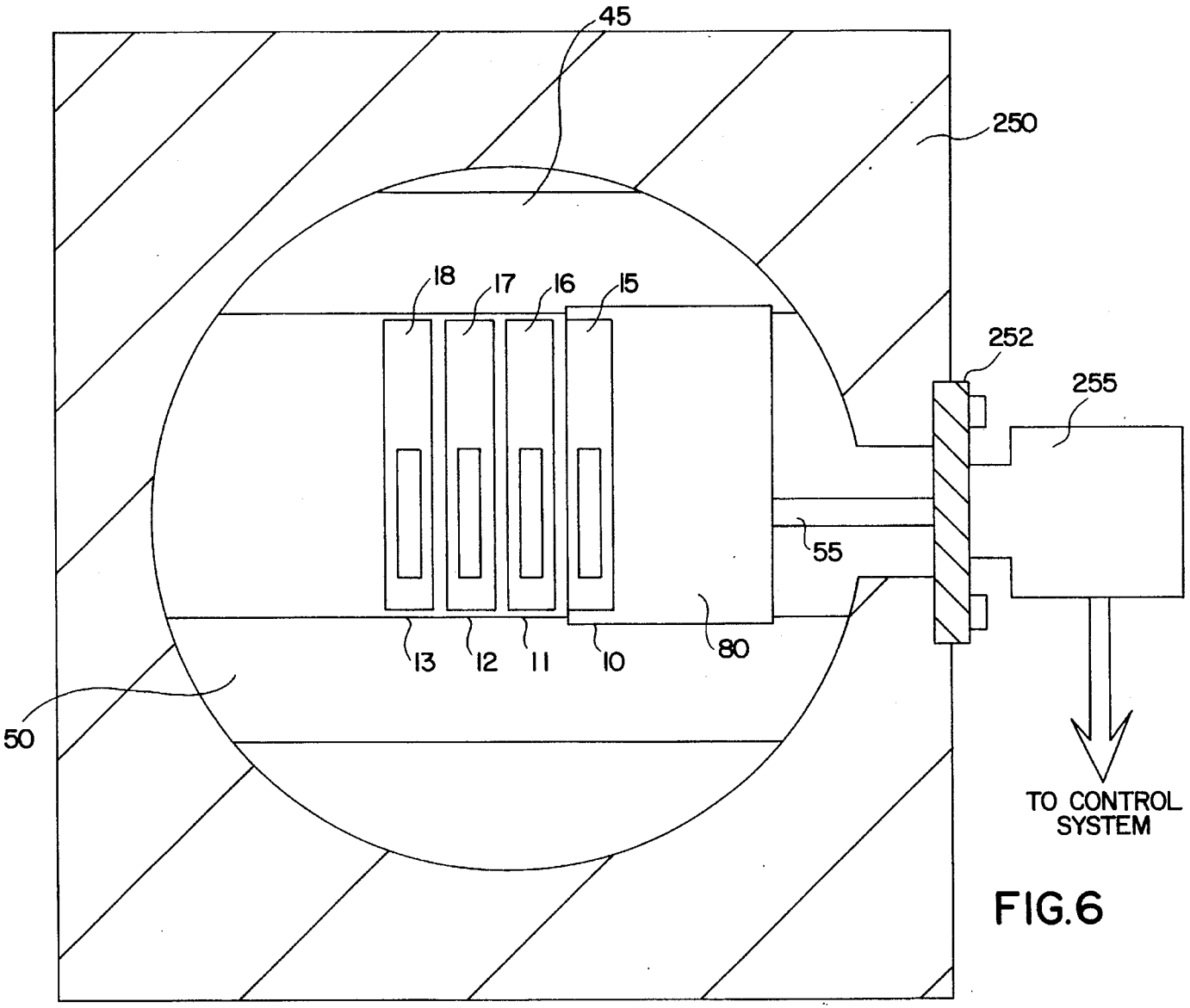
FIG. 6 is a front view of a four-detector assembly as shown in FIGS. 1–3, incorporated in a mass spectrometer.

FIG. 6 is a front view of a four-detector assembly, as shown in FIGS. 1–3, incorporated into a mass spectrometer. A vacuum housing 250 has four pairs of upper and lower runners (only one pair of which, 45 and 50, can be seen in FIG. 6) supporting four detector assemblies, 10–13. Each detector assembly, e.g., 10, is connected via a drive shaft, e.g., 55, to a drive mechanism, e.g., 255. These are bellows-driven micrometer drives which are attached to ports in the vacuum housing 250 by gold wire sealed flanges, only one of which, 252, can be seen in FIG. 6. The drive mechanism may be controlled by a single control system, e.g., a computer (not shown).

Many alternative arrangements of the detector assemblies are possible in addition to those shown in the figures. For example, the angle between the first and second portions of the detector assemblies may not be a right angle. Also, second portions of the detector assemblies need not be parallel to each other.

We claim:

1. A multiple-detector system for detecting a plurality of charged-particle beams in an analytical device, said detector system comprising at least one group of charged particle detector assemblies;

wherein each of said detector assemblies comprises a first arm and a second arm extending at an angle to said first arm, said first arm having a member at one end thereof defining an entrance aperture, said second arm having a detector therein;

wherein said detector assemblies are arranged such that said entrance apertures lie substantially on a first plane which intersects the paths of said charged-particle beams, one or more of said detector assemblies being positioned so that a selected charged-particle beam passes through said entrance aperture of a selected detector assembly into said first arm of said selected assembly;

each said detector assembly further comprising a secondary-emissive element positioned to intersect the path of a said charged particle beam which enters said detector assembly through said entrance aperture, said secondary emissive element emitting secondary particles in response to said charged particle beam incident upon it, such that at least some of said secondary particles pass into said second arm of said detector assembly to be detected by said detector.

2. A multiple-detector system as claimed in claim 1, wherein said charged-particle beams are dispersed to follow different trajectories according to their mass-to-charge ratios, each detector assembly being disposed so as to detect a beam of particles of a particular mass-to-charge ratio.

3. A multiple-detector system as claimed in claim 2, wherein said analytical device comprises a charged-particle focusing system having an optical axis, each said charged-particle beam being focused at a point, said points being disposed at various locations on a focal plane, said focal plane substantially coinciding with said first plane along which said detector assembly entrance apertures lie, said detector assemblies being arranged such that the said focal point of a particular charged-particle beam substantially coincides with the said entrance aperture of a particular assembly.

4. A multiple-detector system as claimed in claim 3, wherein said focal plane of said charged-particle beams is substantially flat and substantially perpendicular to the direction of said optical axis at an exit of said focussing system.

5. A multiple-detector system as claimed in claim 1, wherein said second arms of said detector assemblies are substantially parallel to each other, lengths of said first arms of said detector assemblies within each group progressively increasing by more than a width of a said second arm to enable said detector assemblies within each group to be nested together.

6. A multiple-detector system as claimed in claim 5, wherein said second arm of each detector assembly extends substantially at right angles to said first arm.

7. A multiple-detector system as claimed in claim 6, wherein two groups of detector assemblies are provided, with said second arms of said detector assemblies of said groups being substantially parallel to each other, but with said second arms of one group of detector assemblies extending in substantially an opposite direction to said second arms of the other group of detector assemblies, to form two back-to-back groups of nested detector assemblies.

8. A multiple-detector system as claimed in claim 1, wherein said second arms of each detector assembly extend in various directions so as to be splayed out.

9. A multiple-detector system as claimed in claim 1, wherein each said detector assembly is adjustable in position along said first plane so that charged particles may be detected at varying positions which may be at varying distances apart.

10. A mass spectrometer having a vacuum housing containing:

i. a charged-particle source for producing a charged-particle beam;

ii. a mass analyzer for dispersing said charged-particle beam so that charged particles are dispersed along different trajectories according to mass-to-charge ratio, said dispersed charged-particles being focused by said mass analyzer along a plane, with charged particles of different mass-to-charge ratios being focused at different points along said plane; and iii. a multiple-detector system as defined claim 1.

11. A charged-particle beam detector assembly comprising:

a first arm having a member at one end thereof defining an entrance aperture for receiving a charged-particle beam;

a second arm mounted at an angle to said first arm and having a detector therein; and a secondary-emissive element positioned to intersect a said charged-particle beam entering through said entrance aperture, and to emit secondary particles in response to said charged particle beam incident thereon, such that at least some of said secondary particles passing into said second arm are detected by said detector.

* * * * *